US009010426B2

(12) United States Patent
Saurer

(10) Patent No.: US 9,010,426 B2
(45) Date of Patent: Apr. 21, 2015

(54) SYSTEMS AND METHODS FOR MANAGING MILLING DEBRIS

(75) Inventor: Dan Saurer, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/878,568

(22) PCT Filed: Jul. 11, 2012

(86) PCT No.: PCT/US2012/046183

§ 371 (c)(1),
(2), (4) Date: May 21, 2014

(87) PCT Pub. No.: WO2014/011162

PCT Pub. Date: Jan. 16, 2014

(65) Prior Publication Data

US 2014/0326456 A1 Nov. 6, 2014

(51) Int. Cl.

| | |
|---|---|
| ***E21B 29/00*** | (2006.01) |
| ***E21B 27/00*** | (2006.01) |
| ***E21B 7/06*** | (2006.01) |

(52) U.S. Cl.

CPC ..... *E21B 29/002* (2013.01); *E21B 29/005* (2013.01); *E21B 27/00* (2013.01); *E21B 7/061* (2013.01); *E21B 7/064* (2013.01)

(58) Field of Classification Search

CPC ..... E21B 27/00; E21B 7/061; E21B 7/064; E21B 29/002; E21B 29/00; E21B 29/005

USPC ..... 166/298, 55.2, 117.5, 255.3; 175/61

See application file for complete search history.

(56) References Cited

U.S. PATENT DOCUMENTS

| | | | | |
|---|---|---|---|---|
| 5,778,980 | A * | 7/1998 | Comeau et al. | 166/298 |
| 5,887,655 | A * | 3/1999 | Haugen et al. | 166/298 |
| 5,944,101 | A * | 8/1999 | Hearn | 166/117.5 |
| 6,116,344 | A * | 9/2000 | Longbottom et al. | 166/298 |
| 6,276,452 | B1 * | 8/2001 | Davis et al. | 166/298 |
| 2014/0014343 | A1 | 1/2014 | Saurer | |

OTHER PUBLICATIONS

International Search Report and Written Opinion for PCT/US2012/046183 dated Feb. 19, 2013.

* cited by examiner

*Primary Examiner* — Yong-Suk (Philip) Ro
(74) *Attorney, Agent, or Firm* — McDermott Will & Emery LLP; Alan Bryson

(57) ABSTRACT

An exemplary milling system includes a mill arranged within a shroud and configured to translate axially with respect to the shroud once detached therefrom, a guide block is coupled to a distal end of the mill and supports the mill while the mill forms the casing exit. A guide support is arranged within the shroud defining one or more longitudinal channels configured to accumulate cuttings and debris. The shroud defines a plurality of perforations arranged as first and second axial perforation sets, and a sleeve is arranged therein and defines one or more piston guides that align one or more pistons with either the first or second axial perforation sets, depending on the amount of cuttings and debris.

19 Claims, 5 Drawing Sheets

SYSTEMS AND METHODS FOR MANAGING MILLING DEBRIS

CROSS-REFERENCE TO RELATED APPLICATIONS

The present application claims priority to and is a National Stage entry from International Application No. PCT/US2012/046183 filed on July, 2012.

BACKGROUND

The present invention relates generally to downhole milling operations, and more particularly to systems and methods of managing cuttings and debris resulting from milling a lateral borehole.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a casing joint and a whipstock in a casing string at a desired location in the main wellbore. The whipstock is used to deflect one or more mills laterally (or in an alternative orientation) relative to the casing string. The deflected mill(s) penetrates part of the casing joint to form the casing exit in the casing string. Drill bits can be subsequently inserted through the casing exit in order to cut the lateral or secondary wellbore.

While milling the casing exit, cuttings and debris accumulate within the wellbore as a result of penetrating the metal casing. These cuttings and debris are typically removed to the well surface by circulation of a drilling fluid. As casing exits are increasingly being made at deeper well depths, flushing cuttings and debris to the surface becomes increasingly more difficult. This can also pose a significant problem with lateral exits that are made where the well casing may be near a horizontal exit. Inefficient or inadequate removal of cuttings and debris from the borehole could potentially result in increased difficulty in retrieving the milling system to the well surface.

SUMMARY OF THE INVENTION

The present invention relates generally to downhole milling operations, and more particularly to systems and methods of managing cuttings and debris resulting from milling a lateral borehole.

In some embodiments, a milling system for forming a casing exit is disclosed. The milling system may include a mill arranged within a shroud and configured to translate axially with respect to the shroud once detached therefrom, a guide block coupled to a distal end of the mill and configured to guide and support the mill while the mill forms the casing exit, and a guide support arranged within the shroud and having a ramp portion that transitions into a planar portion, the guide support defining one or more longitudinal channels configured to accumulate cuttings and debris such that the cuttings and debris remain out of a path of the mill as it moves axially along the guide support.

In other embodiments, another milling system for forming a casing exit is disclosed. The milling system may include a shroud defining a plurality of perforations arranged as a first axial perforation set and a second axial perforation set, the first axial perforation set being axially offset uphole from the second axial perforation set, a mill arranged within the shroud and coupled to a stem that extends longitudinally therefrom, one or more pistons arranged about the stem and configured to be actuated radially with respect to the stem in order to engage or disengage the plurality of perforations of either of the first axial perforation set or the second axial perforation set, and a sleeve arranged within the shroud and defining one or more piston guides configured to receive and rotationally align the one or more pistons with the plurality of perforations of either of the first or the second axial perforation sets.

In yet other embodiments, a method for managing cuttings and debris while forming a casing exit is disclosed. The method may include introducing a milling system downhole, the milling system having a mill arranged within a shroud and a guide block coupled to a distal end of the mill and a stem coupled to an opposing end of the mill and extending longitudinally therefrom, radially actuating one or more pistons arranged about the stem in order to disengage the stem and the mill from the shroud, guiding the mill downhole with respect to the shroud with a guide support arranged at least partially within the shroud, the guide support having a ramp portion that transitions into a planar portion, urging the mill into contact with a casing string with the ramp portion and thereby initiating the formation of the casing exit, advancing the mill downhole to continue milling the casing exit, and accumulating at least a portion of the cuttings and debris resulting from the milling of the casing exit within one or more longitudinal channels defined in the guide support.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to downhole milling operations, and more particularly to systems and methods of managing cuttings and debris resulting from milling a lateral borehole.

The exemplary systems and methods described herein effectively manage well cuttings and debris resulting from the milling of a lateral exit in a multilateral well casing. Effective management of the cuttings ensures that they do not impede the retrieval of the milling system to the surface after the lateral exit is created. In some embodiments, for example, the cuttings may be conveyed to or otherwise deposited in additional or enlarged locations provided in the milling system such that they do not obstruct the retrieval path of the milling system. The additional or enlarged locations may further allow the accumulated debris to be better flushed from the well if desired. In other embodiments, one or more elongated alignment slots are provided in the milling system such that any accumulated debris within or adjacent the alignment slots will not prevent the system from retracting into the retrieving or locked position. Consequently, the exemplary milling systems disclosed herein will be more tolerant of downhole cuttings so that the milling systems may efficiently function in more challenging applications, such as generating lateral exits at greater well depths and long horizontal applications. The ability to provide long straight exits into new or existing well casings is believed to provide a significant advantage to lateral borehole milling systems, and those skilled in the art will readily recognize that enhancements to these milling systems that address the effective management of cuttings and debris is a desirable feature.

Figure 1:
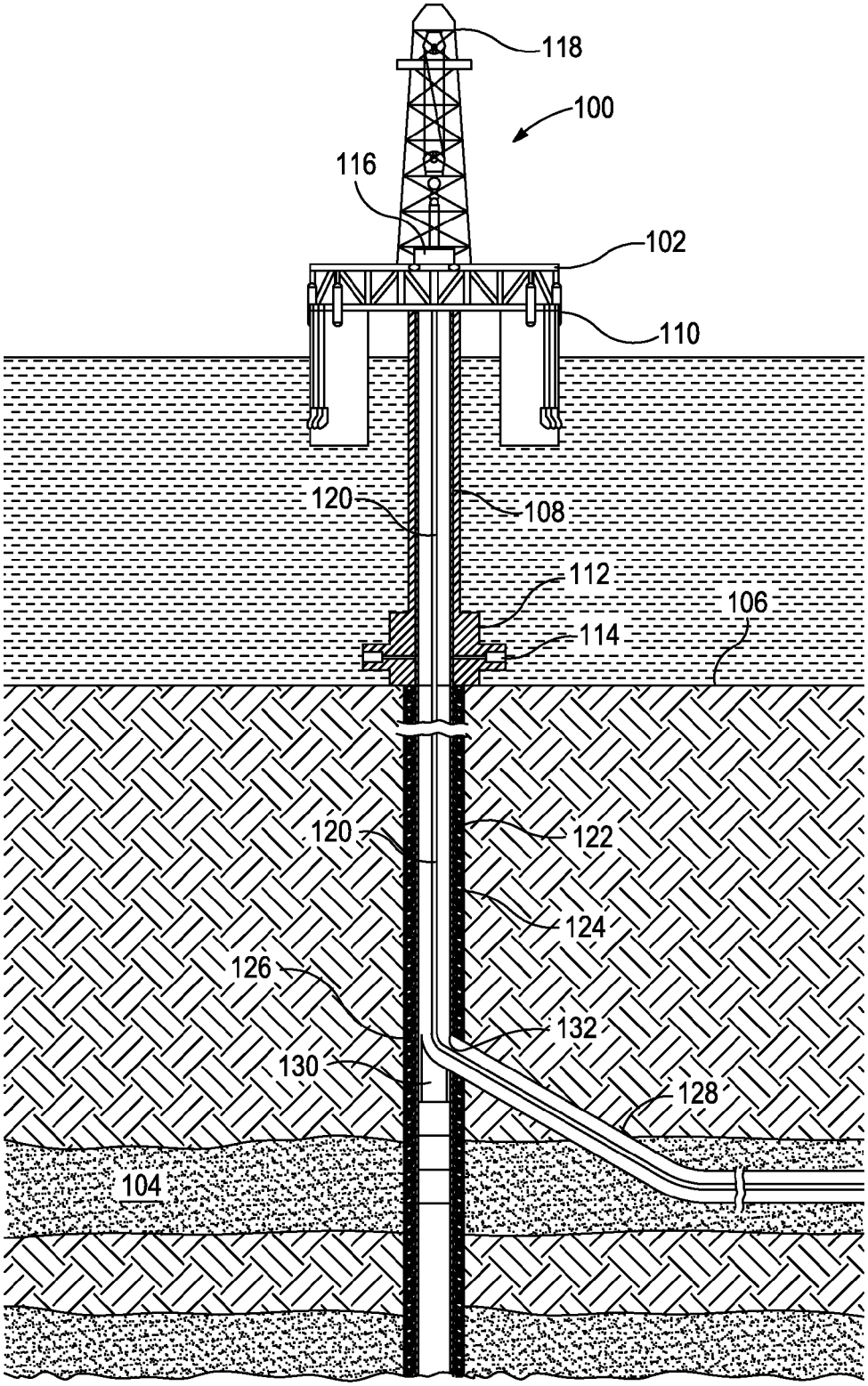
FIG. 1 illustrates an offshore oil and gas platform using an exemplary well system subassembly, according to one or more embodiments disclosed.

Referring to FIG. 1, illustrated is an offshore oil and gas platform 100 that is able to use one or more of the debris management systems described herein, according to one or more embodiments. Even though FIG. 1 depicts an offshore oil and gas platform 100, it will be appreciated by those skilled in the art that the various debris management systems disclosed herein are equally well suited for use in or on other types of oil and gas rigs, such as land-based oil and gas rigs or rigs located at any other geographical site. The platform 100 may be a semi-submersible platform 102 centered over a submerged oil and gas formation 104 located below the sea floor 106. A subsea conduit 108 extends from the deck 110 of the platform 102 to a wellhead installation 112 that includes one or more blowout preventers 114. The platform 102 has a hoisting apparatus 116 and a derrick 118 for raising and lowering pipe strings, such as a drill string 120, within the subsea conduit 108.

As depicted, a main wellbore has been drilled through the various earth strata, including the formation 104. The terms "parent" and "main" wellbore are used herein interchangeably to designate a wellbore from which another wellbore is drilled. It is to be noted, however, that a parent or main wellbore does not necessarily extend directly to the earth's surface, but could instead be a branch of another wellbore. A casing string 124 is at least partially cemented within the main wellbore 122. The term "casing" is used herein to designate a tubular string used to line a wellbore. The casing may actually be of the type known to those skilled in the art as "liner" and may be a segmented liner or a continuous liner, such as coiled tubing.

A casing joint 126 may be interconnected between elongate portions or lengths of the casing string 124 and positioned at a desired location within the wellbore 122 where a branch or lateral wellbore 128 is to be drilled. The terms "branch" and "lateral" wellbore are used herein to designate a wellbore which is drilled outwardly from its intersection or junction with another wellbore, such as a parent or main wellbore. Moreover, a branch or lateral wellbore may have another branch or lateral wellbore drilled outwardly therefrom, without departing from the scope of the disclosure. A whipstock assembly 130, or other types of mill guides described herein, may be positioned within the casing string 124 and/or the casing joint 126. The whipstock assembly 130 or another mill guide may be configured to deflect one or more cutting tools (i.e., mills) into the inner wall of the casing joint 126 such that a casing exit 132 is defined therein at a desired circumferential location. The casing exit 132 provides a "window" in the casing joint 126 through which one or more other cutting tools (i.e., drill bits) may be inserted in order to drill the lateral wellbore 128.

It will be appreciated by those skilled in the art that even though FIG. 1 depicts a vertical section of the main wellbore 122, the embodiments described in the present disclosure are equally applicable for use in wellbores having other directional configurations including horizontal wellbores, deviated wellbores, slanted wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
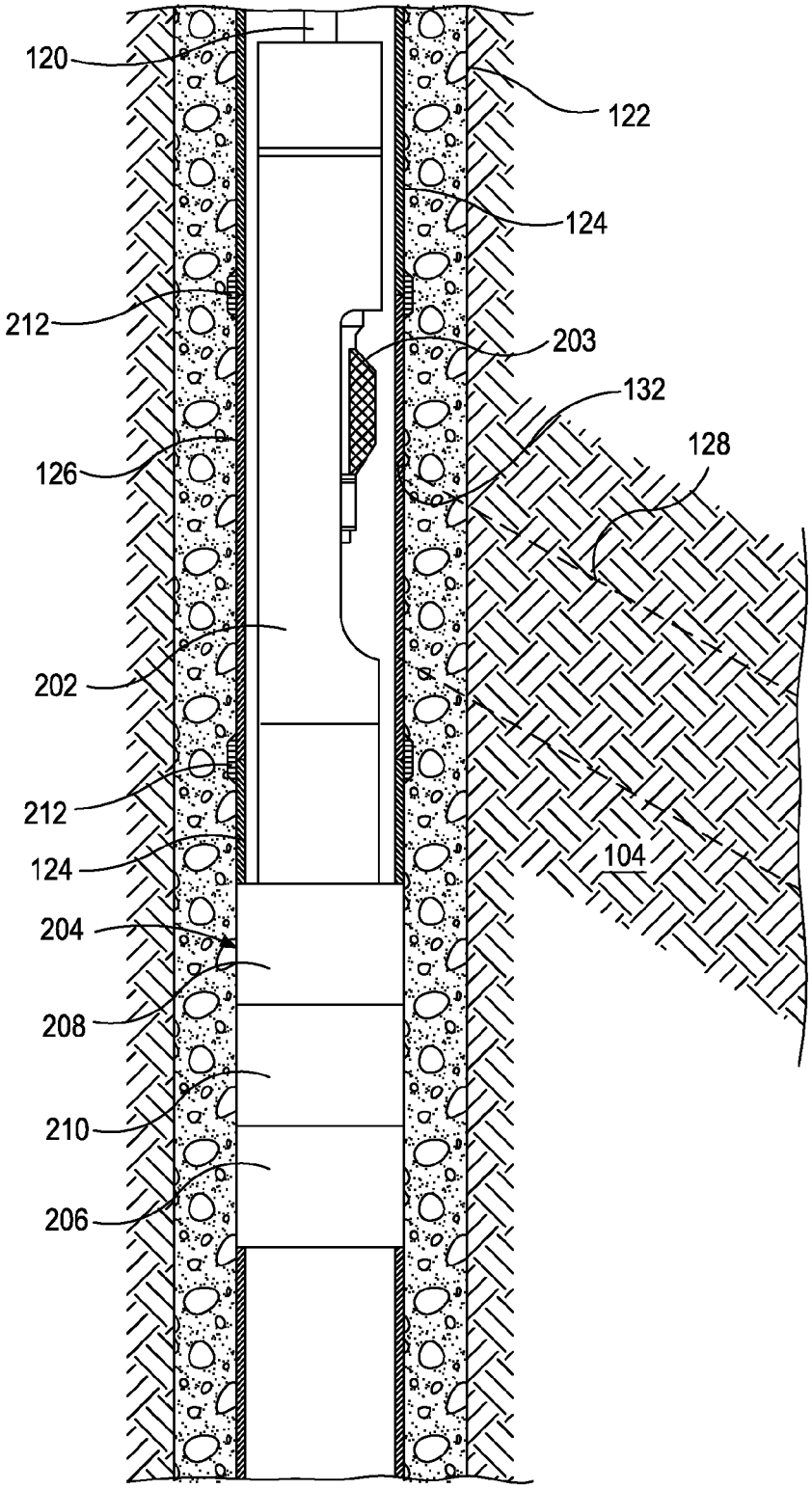
FIG. 2 illustrates an enlarged view of the junction between the parent wellbore and a drilled lateral wellbore.

Referring now to FIG. 2, with continued reference to FIG. 1, illustrated is an enlarged view of the junction between the main wellbore 122 and the lateral wellbore 128 (shown in dashed) before the lateral wellbore 128 is actually drilled or otherwise formed in the surrounding subterranean formation 104. In order to form the lateral wellbore 128, a milling system 202 may be coupled to the drill string 120, inserted into the main wellbore 122, and extended to engage an anchor latch 204 arranged at the location where the lateral wellbore 128 is to be drilled. The milling system 202 may include at least one mill 203 configured to be brought into contact with the casing string 124 in order to mill the casing exit 132 therein. As will be described in more detail below, the milling system 202 may further include a mill guide support (not shown) designed to guide the mill 203 in order to produce straight casing exit 132. In at least one embodiment, the milling system 202 may be or otherwise include the First Pass MILLRITE® system, commercially available from Halliburton Energy Systems of Houston, Tex., USA. In other embodiments, however, the milling system 202 may be any multilateral milling system known to those skilled in the art. For example the milling system 202 may be any milling system that is able to mill a casing exit 132 in the casing string 124 and subsequently drill into the surrounding subterranean formation 104 to form the lateral wellbore 128.

The anchor latch 204 may include various tools and tubular lengths interconnected in order to rotate and align the milling system 202 (both radially and axially) to the correct exit angle orientation and axial well depth in preparation for forming the casing exit 132 and milling the lateral wellbore 128. In some embodiments, the anchor latch 204 may be a Sperry multilateral latch or coupling system available from Halliburton Energy Systems of Houston, Tex., USA. In other embodiments, the anchor latch 204 may be a muleshoe orienting guide with a no-go and shear latch combination, or any other mechanical means used to locate the milling system 202 both on depth within the main wellbore 122 and at the correct exit angle orientation for forming the casing exit 132.

In one or more embodiments, for example, the anchor latch 204 may include a latch coupling 206 having a profile and a plurality of circumferential alignment elements operable to receive a corresponding latch mechanism of the milling system 202 and thereby locate the latch mechanism in a predetermined circumferential orientation. The anchor latch 204 may also include an alignment bushing 208 having a longitudinal slot that is circumferentially referenced to the circumferential alignment elements of the latch coupling 206. Positioned between the latch coupling 206 and the alignment bushing 208 is a casing alignment sub 210 that may be used to ensure proper alignment of the latch coupling 206 relative to the alignment bushing 208. It will be understood by those skilled in the art that the anchor latch 204 may include a greater or lesser number of tools or a different set of tools that are operable to enable a determination of an offset angle between a circumferential reference element and a desired circumferential orientation of the casing exit 132.

The casing joint 126 may be coupled to and otherwise interpose separate elongate segments of the casing string 124. In some embodiments, each end of the casing joint 126 may be threaded to the corresponding elongate lengths of the casing string 124. In other embodiments, however, the casing joint 126 may be coupled to the casing string 124 via couplings 212 made of, for example, steel or a steel alloy (e.g., low alloy steel). The casing string 124 may be made from a corrosive-resistant material, such as 13-chromium, 28-chromium, or other stainless steel or nickel alloys. The casing joint 126 may be made of a softer material or otherwise a material that provides easy milling or drilling therethrough. In one or more embodiments, the casing joint 126 is made of aluminum or an aluminum alloy. In other embodiments, however, the casing joint 126 may be made of various composite materials such as, but not limited to, fiberglass, carbon fiber, combinations thereof, or the like.

Figure 3A:
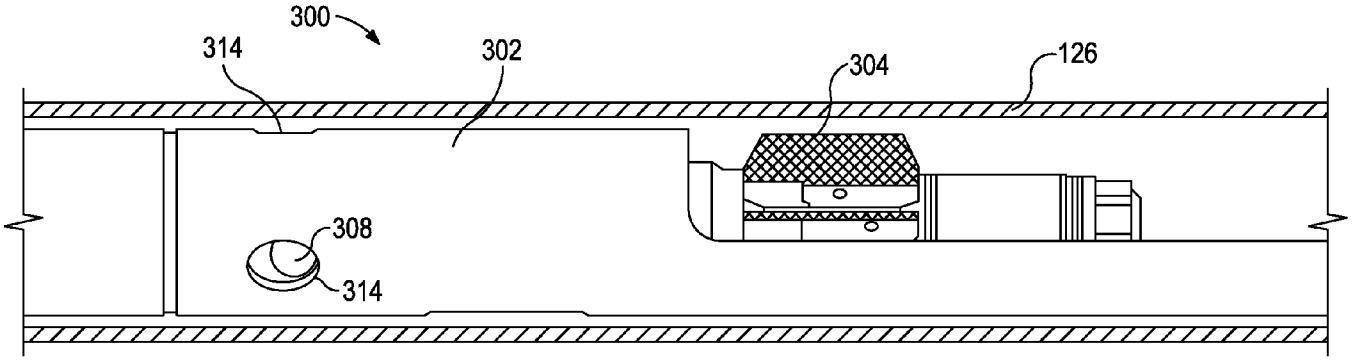
FIGS. 3*a* and 3*b* illustrate partial cross-sectional views of an exemplary milling system, according to one or more embodiments.
Figure 3B:
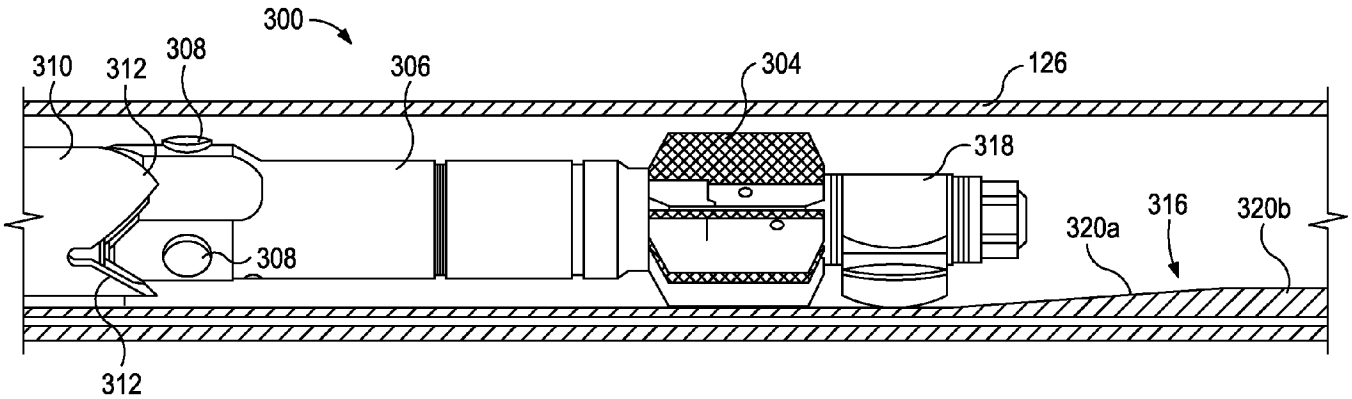

Referring now to FIGS. 3*a* and 3*b*, illustrated are partial cross-sectional views of an exemplary milling system 300 which may be similar in some respects to the milling system 202 of FIG. 2. As illustrated, the milling system 300 is arranged within the casing joint 126 in order to mill out a portion thereof and thereby form the casing exit 132 (FIGS. 1 and 2), as generally described above. As will be appreciated, however, the milling system 300 may equally be arranged within a portion of the casing string 124 (FIGS. 1 and 2) and configured to form the casing exit 132 therein, without departing from the scope of the disclosure.

As shown in FIG. 3*a*, the milling system 300 may include a shroud 302 into which one or more mills 304 (one shown) may be arranged for deployment and retrieval. In some embodiments, the mill 304 is secured to the shroud 302 using one or more shear pins or screws. Upon being appropriately detached from the shroud 302, the mill 304 may be configured to translate axially with respect to the shroud 302. FIG. 3*b* illustrates the milling system 300 with at least a portion of the shroud 302 removed so as to expose some of the inner components of the milling system 300. For instance, as depicted in FIG. 3*b*, the milling system 300 may include a stem 306 and one or more pistons 308 coupled to or otherwise arranged about the stem 306.

The mill 304 may be axially offset from the one or more pistons 308 and rotatably coupled to the distal end of the stem 306. As will be discussed in greater detail below, the pistons 308 may be actuatable and configured to extend and/or retract radially with respect to the stem 306. In some embodiments, the pistons 308 may be equidistantly spaced about the periphery of the stem 306. In other embodiments, however, the pistons 308 may be randomly spaced about the stem 306, without departing from the scope of the disclosure. While only a few pistons 308 are shown in FIGS. 3*a* and 3*b*, the milling system 300 may have any number of pistons 308 coupled to or otherwise arranged about the stem 306, depending on the particular application and/or the design of the shroud 302. Moreover, in some embodiments, the pistons 308 may be omitted entirely from the milling system 300 and instead replaced with a collet or any device capable of axially coupling the mill 304 to the guide support 316, and a key or any device configured to rotationally or radially couple the mill 304 to the guide support 316 for proper retrieval to the surface.

The milling system 300 may further include a sleeve 310 that may also be arranged within the shroud 302 and otherwise fastened thereto such that the sleeve 310 is unable to axially translate with respect to the shroud 302. The sleeve 310 may define one or more piston guides 312 at a distal end thereof. In some embodiments, as illustrated, the piston guides 312 may be generally defined in the shape of a "V". In other embodiments, however, the piston guides 312 may be defined with an arcuate shape, such as in the shape of a "U" or otherwise rounded or curved in some manner. In operation, each piston guide 312 may provide an alignment slot or location configured to receive a corresponding piston 308 as the mill 304 is retracted axially toward the surface (i.e., to the left of FIGS. 3*a* and 3*b*). The contoured or otherwise angled alignment slots of the piston guides 312 may be operable to rotationally align the stem 306 and the mill 304 with the shroud 302 for proper retrieval of the milling system 300. It will be understood by those skilled in the art that the angled alignment slots could equally be used for the alignment of a key or similar device in order to radially couple the mill 304 to the guide support 316.

In exemplary operation to mill the casing exit 132, the milling system 300 is extended downhole from the well surface until a distal end of the shroud 302 engages the anchor latch 204 (FIG. 2) and thereby circumferentially orients and secures the milling system 300 within the casing joint 126 (or casing string 124, depending on the application). The shroud 302 may define one or more perforations 314 (FIG. 3*a*) therein, each of which may be configured to receive a corresponding piston 308 therein. In one or more embodiments, the pistons 308 may be spring loaded and therefore configured to naturally extend radially into the one or more perforations 314, thereby locking the mill 304 in place axially within the shroud 302 as the milling system 300 is introduced downhole.

Once the milling system 300 is properly oriented (rotationally and axially) and secured within the casing joint 126 (or casing string 124, depending on the application), a drilling fluid may be pumped from the well surface to the milling system 300 and exit at or near the mill 304. In some applications, the fluid pressure of the drilling fluid may serve to engage or otherwise rotate the mill 304. The drilling fluid may also provide a lubricant and a cooling means for the mill 304 as it cuts into the casing joint to form the casing exit 132. In some embodiments, the drilling fluid also serves to flush cuttings and other debris away from the milling system 300 and toward the well surface. In at least one embodiment, the drilling fluid may also be configured to actuate the pistons 308, thereby radially retracting the pistons 308 from their engagement with the corresponding perforations 314 of the shroud 302. Radially retracting the pistons 308 frees the stem 306 and the mill 304 from engagement with the shroud 302 and thereby allows the mill 304 to move axially downhole with respect to the shroud 302.

As depicted in FIG. 3*b*, the milling system 300 may further include a guide support 316 that either forms an integral part of the shroud 302 or is otherwise coupled or attached thereto. The guide support 316 may be a generally arcuate and elongate member that supports and guides the mill 304 as it moves axially downhole to mill the casing exit 132. In particular, the guide support 316 may be configured to guide the mill 304 into milling engagement with the casing joint 126 and subsequently maintain the mill 304 in a substantially straight line with respect to the main wellbore 122 as the mill 304 continues its axial movement. The mill 304 may include a guide block 318 (also known as a "traveling guide block" or a "mill block") which may generally support and guide the mill 304 within the guide support 316. Further description of the guide support 316 and its interaction with the mill 304 and the guide block 318 may be found in co-owned U.S. Pat. No. 5,778,980, entitled "Multicut Casing Window Mill and Method for Forming a Casing Window," the contents of which are hereby incorporated by reference to the extent not inconsistent with the present disclosure.

Figure 4:
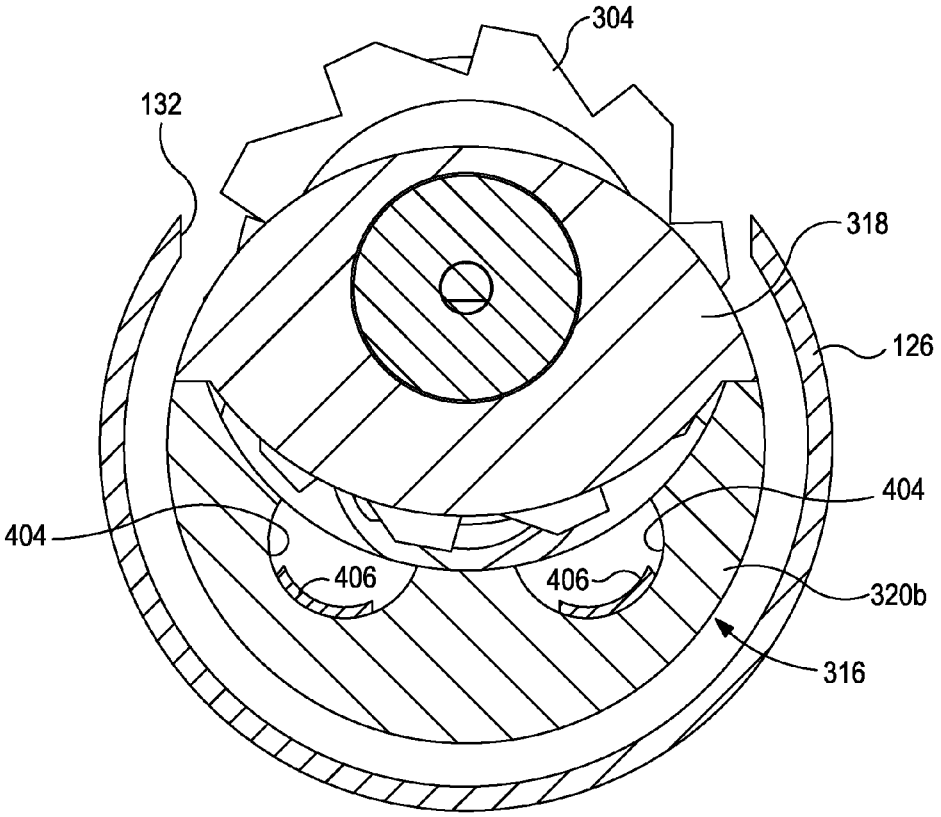
FIG. 4 illustrates a cross-sectional end view of an exemplary guide support and guide block, according to one or more embodiments.

As illustrated, the guide support 316 may define or otherwise form a ramp portion 320*a* that transitions into a planar portion 320*b*. As the mill 304 advances downhole, the guide block 318 translates axially along the ramp portion 320*a* which gradually urges the rotating mill 304 into contact with the inner surface of the casing joint 126, thereby initiating the formation of the casing exit 132. As the mill 304 continues advancing downhole, the guide block 318 moves along the planar portion 320*b* of the guide support 316 and the axial length or opening of the casing exit 132 is correspondingly extended. It should be noted that as used herein, the term "planar," as in "planar portion 320*b*," refers to a generally flat or level portion of the guide support 316 as viewed from a side cross-sectional perspective (e.g., FIGS. 3*b* and 6*b*). As shown in FIG. 4, however, the planar portion 320*b* is depicted as having a generally curved or arcuate end cross-sectional shape, but could, in at least one embodiment, have a flat end cross-sectional shape, without departing from the disclosure.

Referring now to FIG. 4, with continued reference to FIGS. 3*a* and 3*b*, illustrated is a cross-sectional end view of the guide block 318 as supported by the guide support 316, according to one or more embodiments disclosed. In particular, FIG. 4 may depict the guide block 318 as being supported on the planar portion 320*b* of the guide support 316 and the mill 304 may be depicted as having already milled through a portion of the casing joint 126 to form a corresponding portion of the casing exit 132. As illustrated, in some embodiments, the guide support 316 may define one or more longitudinal conduits or channels 404. While only two channels 404 are depicted in FIG. 4, it will be appreciated that more or less than two channels 404 may be employed, without departing from the disclosure.

As illustrated, the longitudinal channels 404 may be defined or otherwise formed in the planar portion 320*b* of the guide support 316. The longitudinal channels 404 may extend substantially the whole length of the planar portion 320*b* so as to be in close proximity to the cuttings as they are generated. In other embodiments, however, the longitudinal channels 404 may be formed in the ramp portion 320*a* (FIGS. 3*a* and 3*b*), or both the ramp and planar portions 320*a,b*, without departing from the scope of the disclosure. In operation, the longitudinal channels 404 may be configured to manage cuttings and debris derived from forming the casing exit 132 such that the mill 304 is able to be retracted without interfering with the casing exit 132.

For instance, excessive accumulation of cuttings and debris along the guide support 316 may prohibit the mill 304 from appropriately re-entering the guide support 316. As a result, upon being retracted toward the shroud 302 (FIG. 3*a*), the mill 304 may contact and thereby become hung up on the casing exit 132, which prevents its axial retraction. Accordingly, in some embodiments, the longitudinal channels 404 may be configured to provide an area or means along the length of the guide support 316 that may be used to efficiently flush cuttings or other debris away from the path of the mill 304. As a result, cuttings and debris are less likely to interfere with the retraction process of the mill 304.

In other embodiments, however, the longitudinal channels 404 may be used to accumulate cuttings and/or debris during the milling operations. For example, each channel 404 may provide a longitudinal area where the cuttings and/or debris may settle or otherwise remain out of the way of the mill 304 as it moves axially along the longitudinal length of the guide support 316. In some embodiments, the longitudinal channels 404 may have one or more magnets 406 arranged therein and mechanically fastened thereto using mechanical fasteners, adhesives, welding or brazing techniques, combinations thereof, or the like. In operation, the magnets 406 may be configured to magnetically attract accumulated cuttings and any metallic debris that may be present.

Figure 5A:
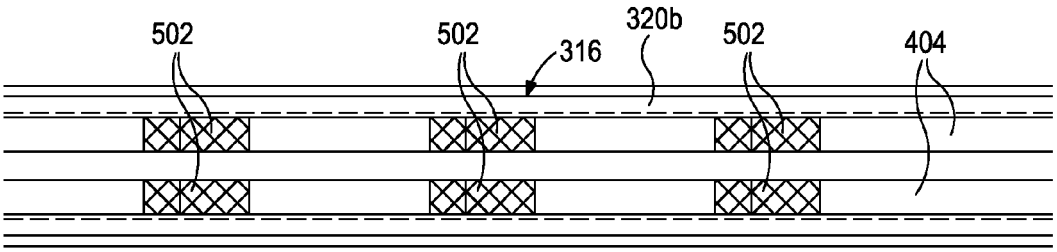
FIGS. 5*a* and 5*b* illustrate top and side cross-sectional views, respectively, of a guide support having a plurality of pockets arranged within longitudinal channels.
Figure 5B:
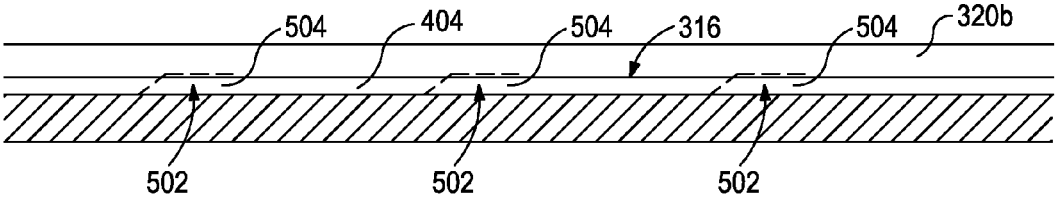

In other embodiments, the longitudinal channels 404 may simply provide a means to mechanically trap the cuttings therein. For instance, and referring now to FIGS. 5*a* and 5*b*, with continued reference to FIG. 4, a plurality of pockets 502 may be arranged longitudinally within the longitudinal channels 404 and axially offset from each other. Specifically, FIGS. 5*a* and 5*b* depict top and side cross-sectional views, respectively, of the guide support 316 having a plurality of pockets 502 arranged within the longitudinal channels 404. In some embodiments, the pockets may be mesh structures made from rigid or flexible materials such as, but not limited to, metals, plastics, rubbers and elastomers, carbon fiber, combinations thereof, and the like. Each pocket may define an entrance 504 (FIG. 5*b*) into the pocket 502 on its downhole end, but taper or otherwise close at its uphole end, thereby providing a cage-like structure.

In operation, debris and cuttings flowing within the longitudinal channels 404 may enter into the various pockets 502 via the corresponding entrances 504 and thereby become trapped therein. Moreover, as illustrated, the pockets 502 may be arranged substantially flush with the guide support 316 such that the mill 304 (FIG. 4) is able to be pulled back through the guide support 316 after milling operations have ceased. In one or more additional embodiments, however, the cuttings and/or debris could be mechanically trapped within the longitudinal channels 404 using a fiber cord that is configured to entangle the debris.

As will be appreciated by those skilled in the art, the longitudinal channels 404 may prove advantageous, especially in applications where the guide support 316 is arranged in a long horizontal section of the main wellbore 122 (FIGS. 1 and 2) where it is difficult to flush or otherwise circulate the cuttings and debris out of the main wellbore 122. Instead of attempting to flush the cuttings and/or debris out of the main wellbore 122, the longitudinal channels 404 provide a place for the cuttings and debris to reside until after the milling system 300 (FIGS. 3*a* and 3*b*) has begun to be retrieved to the well surface, or during the whole process of retrieving the milling system 300 to the well surface.

Referring again to FIGS. 3*a* and 3*b*, once the casing exit 132 (FIGS. 1,2, and 4) is properly milled or otherwise formed, the milling system 300 can then be retrieved back to the well surface. To accomplish this, the mill 304 and guide block 318 are retracted or otherwise pulled back towards the sleeve 310 (i.e., the left direction in FIG. 3*b*) so that the stem 306 can once again be properly coupled to the shroud 302. As the pistons 308 engage the angled piston guides 312, the stem 306, the mill 304, and the guide block 318 are axially and rotationally locked (e.g., aligned) within the shroud 302 for proper retrieval to the well surface. Moreover, once the pistons 308 properly engage the piston guides 312, each piston 308 will be aligned with a corresponding perforation 314 defined in the shroud 302.

Upon proper alignment of the pistons 308 with a corresponding perforation 314, the pistons 308 may then be extended radially outward into the perforations 314 to re-secure the stem 306, the mill 304, and the guide block 318 to the shroud 302. In some embodiments, the pistons 308 are extended into the perforations 314 by ceasing the circulation of drilling fluid through the milling system 300, which allows the springs in each piston 308 to naturally bias the corresponding piston 308 radially outward. In other embodiments, the pistons 308 may be actuated radially outward mechanically, hydraulically, combinations thereof, or the like, without departing from the scope of the disclosure.

Again, as noted above, in some embodiments the pistons 308 may be replaced with a collet or similar securing means configured to provide an axial force coupling and a key configured to provide a radial force coupling. The collet and key assembly may equally be configured to re-secure the stem 306, the mill 304, and the guide block 318 to the shroud 302. What is desired is the ability to engage the mill 304 in the retracted position so that it can be verified at the surface that it is actually retracted. Those skilled in the art will readily appreciate that if one can set weight down on the drill string 120 (FIG. 2) and the mill 304 does not advance downhole, or if one can build torque on the drill string 120, these would be surface indications that the mill 304 is appropriately in its retracted position.

Figure 6A:
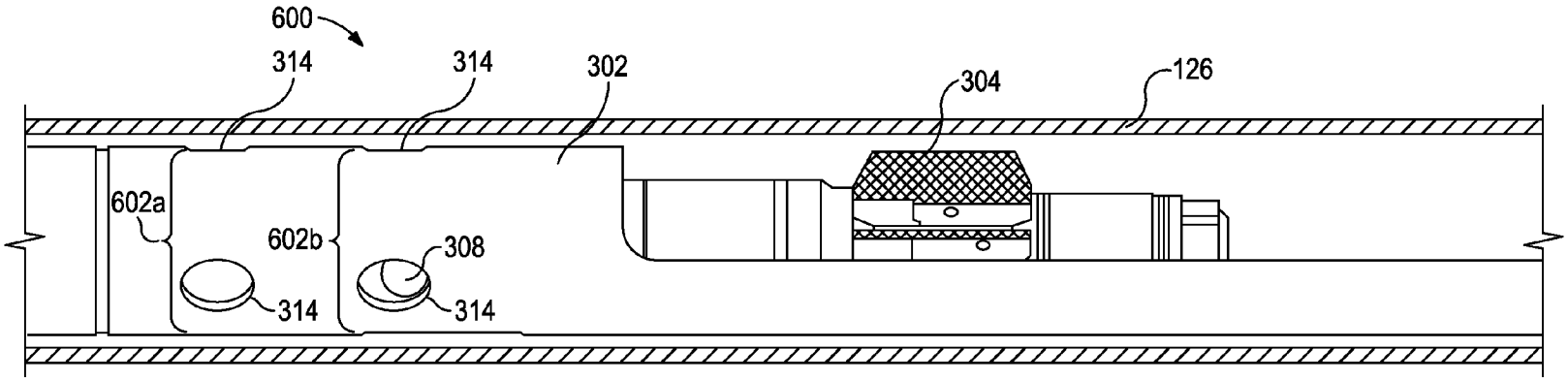
FIGS. 6*a* and 6*b* illustrate partial cross-sectional views of another exemplary milling system, according to one or more embodiments.
Figure 6B:
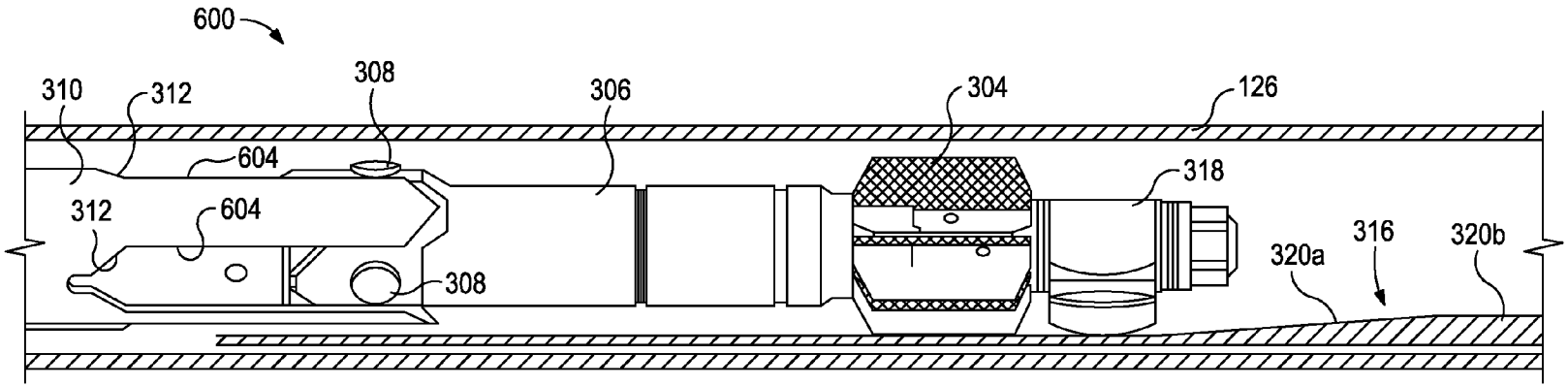

Referring now to FIGS. 6*a* and 6*b*, illustrated are partial cross-sectional views of another exemplary milling system 600, according to one or more embodiments. The milling system 600 may be similar in some respects to the milling system 300 of FIGS. 3*a* and 3*b*, and therefore may be best understood with reference thereto, where like numerals will indicate like elements not described again in detail. As shown in FIG. 6*a*, the shroud 302 may again define one or more perforations 314, each being configured to potentially receive a corresponding piston 308 therein in order to secure the stem 306, the mill 304, and the guide block 318 to the shroud 302 for delivery and/or retrieval.

As will be discussed in greater detail below, the perforations 314 may be configured in at least a first axial perforation set 602*a* and a second axial perforation set 602*b*, where the first axial perforation set 602*a* is axially offset and arranged uphole from the second axial perforation set 602*b*. Depending on the conditions downhole, the pistons 308 may be able to properly engage either the first or the second axial perforation sets 602*a,b*. Each axial perforation set 602*a,b* may include one or more perforations 314 that may be either equidistantly offset from each other about the circumference of the shroud 302 or otherwise randomly offset from each other. Moreover, while only two axial perforation sets 602*a,b* are depicted, those skilled in the art will readily recognize that more than two axial perforation sets 602*a,b* may be employed in the system 600, without departing from the scope of the disclosure.

FIG. 6*b* illustrates the milling system 600 with at least a portion of the shroud 302 removed so as to expose the inner components of the milling system 600. In the illustrated embodiment, the piston guides 312 defined by the sleeve 310 may be extended longitudinally such that each provides or otherwise forms a corresponding elongate alignment slot 604 configured to receive a corresponding piston 308 therein. As the mill 304 is retracted axially toward the well surface (i.e., to the left of FIGS. 6*a* and 6*b*), the pistons 308 engage and are received within the alignment slots 604 which cooperatively operate to rotationally align each piston 308 with a corresponding perforation 314 defined in the shroud 302. Rotationally aligning the pistons 308 with corresponding perforations 314 also serves to rotationally lock the stem 306 and the mill 304 with respect to the shroud 302 such that the milling system 600 can be properly retrieved to the well surface.

In some milling applications, however, the cuttings and debris generated during the formation of the casing exit 132 may be substantially abundant or otherwise of sufficient quantity that they impede the axial retraction of the mill 304 towards the well surface. For instance, in some applications, substantial accumulation of cuttings and/or debris may become lodged in the piston guides 312 and thereby mechanically prevent the pistons 308 from axially advancing in order to align with and engage the perforations 314 of the first axial perforation set 602*a*. In such a case, the pistons 308 may alternatively be aligned with and engage the perforations 314 of the second axial perforation set 602*b*, and thereby equally secure the stem 306, the mill 304, and the guide block 318 to the shroud 302 for retrieval to the well surface. Since the second axial perforation set 602*b* is located downhole from the first perforation set 602*a*, the alignment slots 604 provide additional axial space where cuttings and/or debris are less likely to prevent the pistons 308 from engaging the perforations 314 of the second axial perforation set 602*b*.

Accordingly, those skilled in the art will readily recognize that the first and second axial perforation sets 602*a,b* may be representative of or otherwise characterized as alternative or secondary engagement locations for rotationally and axially locking the stem 306 and the mill 304 to the shroud 302. Such a secondary engagement location may be employed irrespective of how the radial and/or axial engagement of the stem 306 to the shroud 302 is accomplished. For instance, even in the event of an accumulation of cuttings and debris within the alignment slots 604, the milling system 600 can be properly retrieved to the well surface not only by using the one or more pistons 308 but equally using a collet and key assembly, as generally described above. In yet other embodiments, the secondary engagement locations may be used to rotationally and axially lock the stem 306 and the mill 304 to the shroud 302 using any device or means.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A milling system for forming a casing exit, comprising:

a mill arranged within a shroud and configured to translate axially with respect to the shroud once detached from the shroud;

a guide block coupled to a distal end of the mill and configured to guide and support the mill while the mill forms the casing exit;

a guide support arranged within the shroud and having a ramp portion that transitions into a planar portion, the guide support defining one or more longitudinal channels configured to accumulate cuttings and debris such that the cuttings and debris remain out of a path of the mill as the mill moves axially along the guide support; and one or more magnets arranged within the one or more longitudinal channels, the one or more magnets being configured to magnetically attract the cuttings and debris.

2. The milling system of claim 1, wherein the guide support forms an integral part of the shroud.

3. The milling system of claim 1, wherein the one or more longitudinal channels are defined on the planar portion of the guide support.

4. The milling system of claim 1, wherein the one or more longitudinal channels are defined on both the ramp portion and the planar portion of the guide support.

5. The milling system of claim 1, further comprising one or more pockets arranged longitudinally within the longitudinal channels and defining an entrance at a downhole end to capture cuttings and debris.

6. The milling system of claim 5, wherein the one or more pockets are mesh-like structures.

7. A milling system for forming a casing exit, comprising:

a shroud defining a plurality of perforations arranged as a first axial perforation set and a second axial perforation set, the first axial perforation set being axially offset uphole from the second axial perforation set;

a mill arranged within the shroud and coupled to a stem that extends longitudinally from the mill;

one or more pistons arranged about the stem and configured to be actuated radially with respect to the stem in order to engage or disengage the plurality of perforations of either of the first axial perforation set or the second axial perforation set; and a sleeve arranged within the shroud and defining one or more piston guides configured to receive and rotationally align the one or more pistons with the plurality of perforations of either of the first or the second axial perforation sets.

8. The milling system of claim 7, wherein the one or more piston guides define corresponding elongate alignment slots that provide axial space for the pistons to axially translate and locate and engage either the first axial perforation set or the second axial perforation set.

9. The milling system of claim 7, wherein rotationally aligning the pistons with the plurality of perforations also rotationally locks the stem and the mill, both rotationally and axially, with respect to the shroud such that the milling system can be properly retrieved to a well surface.

10. The milling system of claim 9, wherein the milling system is axially and rotationally aligned with the well surface.

11. A method for managing cuttings and debris while forming a casing exit, comprising:

introducing a milling system downhole, the milling system having a mill arranged within a shroud and a guide block coupled to a distal end of the mill and a stem coupled to an opposing end of the mill and extending longitudinally from the mill;

disengaging the stem and the mill from the shroud by radially actuating one or more pistons arranged about the stem;

guiding the mill downhole with respect to the shroud with a guide support arranged at least partially within the shroud, the guide support having a ramp portion that transitions into a planar portion;

urging the mill into contact with a casing string with the ramp portion and thereby initiating the formation of the casing exit;

advancing the mill downhole to continue milling the casing exit; and accumulating at least a portion of the cuttings and debris resulting from the milling of the casing exit within one or more longitudinal channels defined in the guide support.

12. The method of claim 11, wherein the one or more longitudinal channels are defined on the planar portion of the guide support.

13. The method of claim 11, wherein the one or more longitudinal channels are defined on both the ramp portion and the planar portion of the guide support.

14. The method of claim 11, wherein guiding the mill downhole further comprises supporting the mill with the guide block which engages the guide support.

15. The method of claim 11, further comprising capturing cuttings and debris within one or more pockets arranged longitudinally within the longitudinal channels, each pocket defining an entrance at a downhole end thereof.

16. The method of claim 11, further comprising magnetically-attracting the cuttings and debris into the one or more longitudinal channels with one or more magnets arranged therein.

17. The method of claim 11, further comprising:

retracting the mill back toward the shroud, the shroud defining a plurality of perforations arranged as a first axial perforation set and a second axial perforation set, the first axial perforation set being axially offset uphole from the second axial perforation set;

engaging and receiving the one or more pistons with one or more piston guides defined on a sleeve arranged within the shroud; and rotationally aligning with the one or more piston guides the one or more pistons with the plurality of perforations of either of the first or the second axial perforation sets.

18. The method of claim 17, further comprising:

advancing the one or more pistons within the one or more piston guides until axially aligning with either the first axial perforation set or the second axial perforation set; and in the event the cuttings and debris prevent the one or more pistons from advancing to the first axial perforation set, radially actuating the one or more pistons at the second axial perforation set in order to re-engage the stem and the mill to the shroud.

19. The method of claim 17, wherein rotationally aligning the one or more pistons with the plurality of perforations further comprises rotationally and axially locking the stem and the mill with respect to the shroud such that the milling system can be properly retrieved to a well surface.

* * * * *